US008413588B2

(12) United States Patent
Kelly et al.

(10) Patent No.: US 8,413,588 B2
(45) Date of Patent: Apr. 9, 2013

(54) RAILWAY SERVICE VEHICLE HAVING WHEELCHAIR RESTRAINT

(75) Inventors: Michael J. Kelly, Bloomingdale, IL (US); Glenda J. Bleau, Livonia, MI (US); Christopher M. Larsen, Farmington Hills, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 200 days.

(21) Appl. No.: 12/940,654

(22) Filed: Nov. 5, 2010

(65) Prior Publication Data

US 2011/0120341 A1 May 26, 2011

Related U.S. Application Data

(60) Provisional application No. 61/258,887, filed on Nov. 6, 2009.

(51) Int. Cl.
*E01B 27/17* (2006.01)

(52) U.S. Cl.
USPC ..... 104/8; 410/7

(58) Field of Classification Search ..... 105/26.1, 105/355, 329.1; 104/287
See application file for complete search history.

(56) References Cited

U.S. PATENT DOCUMENTS 1,561,510 A * 11/1925 Dutton ..... 105/72.2
3,196,803 A * 7/1965 Plasser et al. ..... 104/8
3,401,642 A * 9/1968 Fisher ..... 104/8
3,621,790 A * 11/1971 Broome ..... 104/287
3,874,306 A * 4/1975 Coons et al. ..... 105/72.2
3,934,515 A 1/1976 Cushman
3,955,847 A * 5/1976 Schiowitz ..... 296/65.04
4,086,856 A * 5/1978 Chenoweth ..... 105/1.4
4,103,934 A * 8/1978 Arnholt et al. ..... 280/807
4,455,046 A 6/1984 Linderoth
4,511,171 A 4/1985 Peterson
4,588,340 A 5/1986 Howard
4,601,620 A 7/1986 Bugger et al.
4,623,289 A 11/1986 Apostolos
4,671,713 A 6/1987 Lenkman
4,671,729 A 6/1987 McFarland
4,688,843 A * 8/1987 Hall ..... 296/65.04
4,690,364 A * 9/1987 Constantin ..... 248/503.1
4,730,964 A 3/1988 Joyner
4,797,042 A 1/1989 McFarland
4,805,954 A 2/1989 Lazaroff
4,886,403 A * 12/1989 Gresham ..... 410/10
4,966,392 A * 10/1990 Featon et al. ..... 280/801.1
4,973,022 A * 11/1990 Mayland ..... 248/503.1
4,995,775 A * 2/1991 Gresham ..... 410/10
5,165,839 A 11/1992 Aoki
5,186,585 A * 2/1993 Sousa et al. ..... 410/9
(Continued)

*Primary Examiner* — Jason C Smith
(74) *Attorney, Agent, or Firm* — Harness, Dickey & Pierce, P.L.C.

(57) ABSTRACT

A railway service vehicle for transporting material into or wheelchair-bound or injured persons away from train accident sites or tunnels includes a body having a platform. Wheels rotatably connected to the body support the body on first and second rails of a railroad track system for non-self propelled movement of the body. At least one mounting device is connected to the platform. A hold-down member releasably connected to the mounting device restrains a wheelchair supported by the platform. A storage/tool container is supported by the platform. At least one passenger seat is connected to the storage/tool container. Opposed first and second containment members are connected to the platform outboard of the mounting device.

21 Claims, 13 Drawing Sheets

U.S. PATENT DOCUMENTS 5,230,288 A * 7/1993 Bickel ..... 105/425
5,628,595 A 5/1997 Harris
5,884,563 A * 3/1999 Sheldon et al. ..... 104/53
5,888,038 A * 3/1999 Ditch et al. ..... 410/7
5,934,198 A * 8/1999 Fraser ..... 105/144
6,113,325 A 9/2000 Craft
6,231,283 B1 5/2001 Stowers
6,234,732 B1 5/2001 Trippensee et al.
6,287,060 B1 * 9/2001 Girardin ..... 410/7
6,352,396 B1 3/2002 Budd et al.
6,428,254 B2 8/2002 Craft
6,471,454 B1 * 10/2002 Koller ..... 410/7
6,524,039 B1 2/2003 Magnuson et al.
6,575,677 B2 * 6/2003 Craft ..... 410/7
6,599,080 B1 * 7/2003 Karlsson ..... 414/663
6,641,342 B1 * 11/2003 Girardin ..... 410/106
6,698,983 B1 * 3/2004 Kiernan et al. ..... 410/23
6,776,564 B1 * 8/2004 Kiernan et al. ..... 410/23
6,966,733 B2 * 11/2005 Craft ..... 410/7
7,040,847 B1 * 5/2006 Cardona ..... 410/7
7,108,466 B2 * 9/2006 Panzarella et al. ..... 410/7
7,160,068 B2 1/2007 Scialabba et al.
7,425,110 B2 * 9/2008 Ditch ..... 410/9
7,455,490 B1 * 11/2008 Goosen ..... 410/7
7,717,655 B2 * 5/2010 Cardona ..... 410/7
2010/0078291 A1 * 4/2010 Fritsche ..... 198/324
2011/0079167 A1 * 4/2011 Yao ..... 105/1.4
2011/0120341 A1 * 5/2011 Kelly et al. ..... 104/287

* cited by examiner

FIG 3
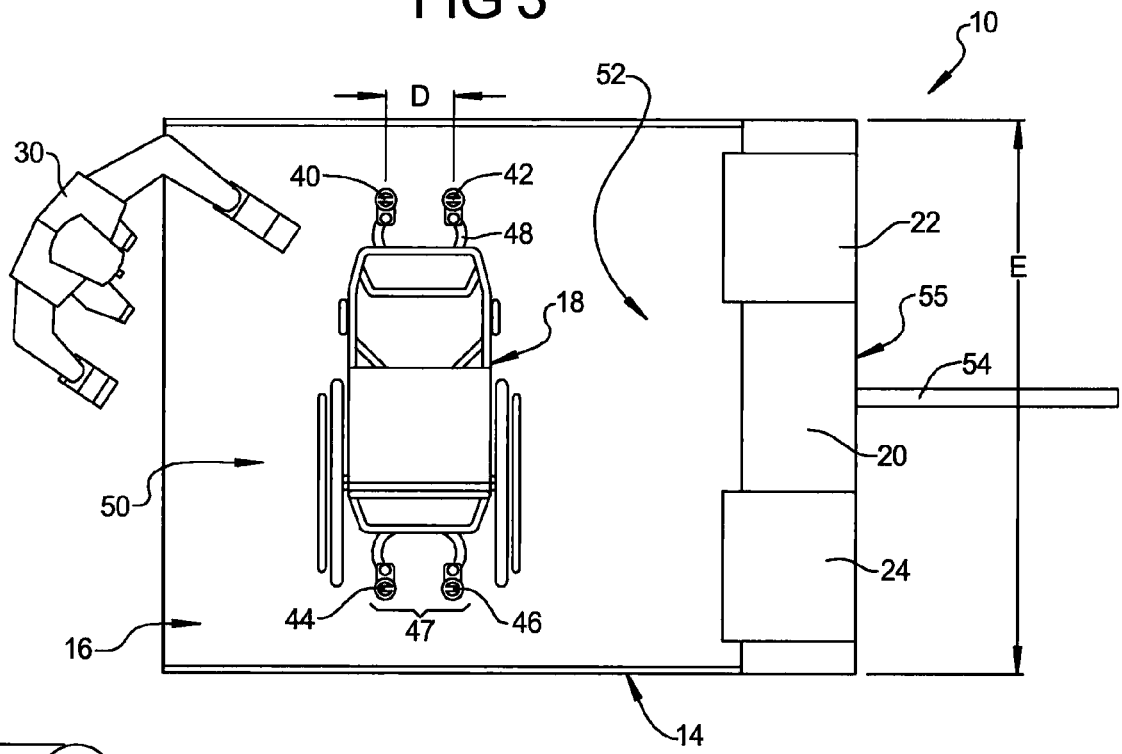
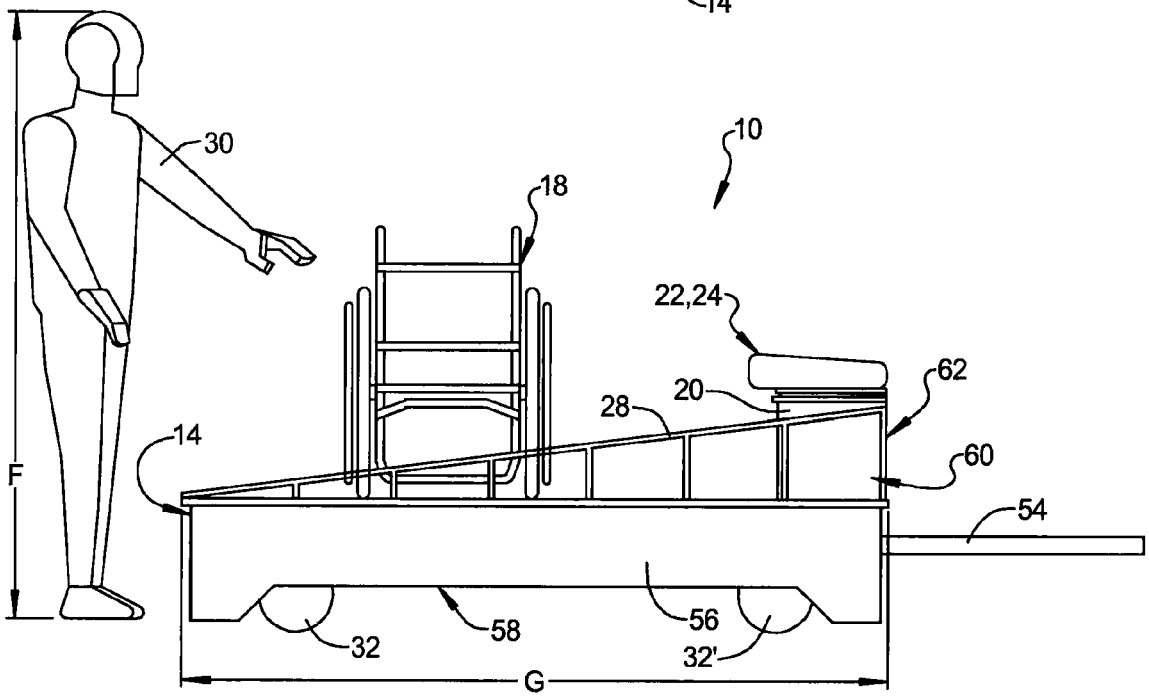
FIG 4

FIG 7
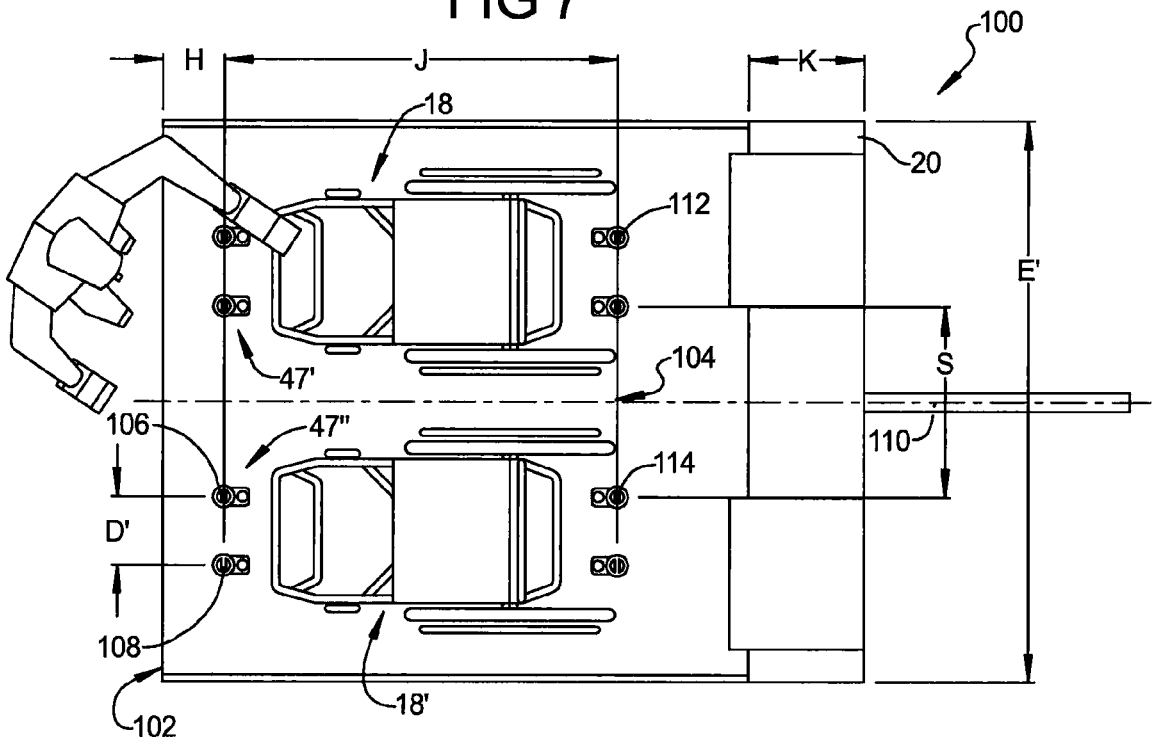
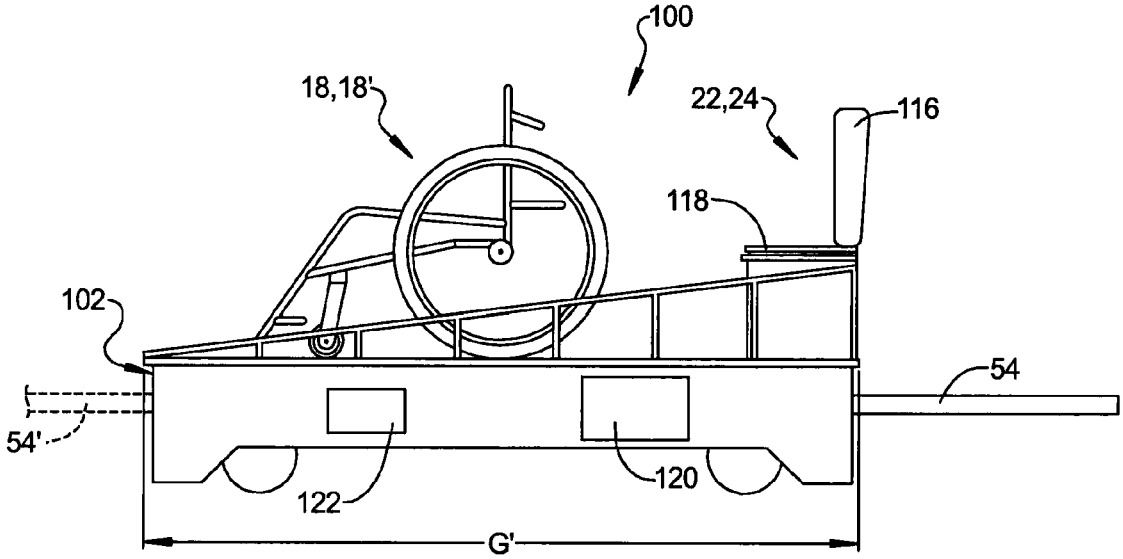
FIG 8

RAILWAY SERVICE VEHICLE HAVING WHEELCHAIR RESTRAINT

CROSS-REFERENCE TO RELATED APPLICATIONS

This application claims the benefit of U.S. Provisional Application No. 61/258,887, filed on Nov. 6, 2009. The entire disclosure of the above application is incorporated herein by reference.

FIELD

The present disclosure relates to service vehicles for operation on railway tracks adapted to carry one or more wheelchairs as well as supplies for emergency response.

BACKGROUND

This section provides background information related to the present disclosure which is not necessarily prior art.

Emergency vehicles are often limited with respect to the spaces and locations they can access to reach victims of accidents, fires, explosions and the like. This is particularly true for emergency vehicles necessary to reach victims of railway accidents, due particularly to the limited ingress and egress locations of railway systems. When trains are stopped in areas such as tunnels or on bridges, emergency access to reach and evacuate injured and/or disabled individuals is particularly limited. Railway service vehicles available to help in emergency situations have limited or no capability to move injured and/or disabled individuals such as those confined to wheelchairs.

SUMMARY

This section provides a general summary of the disclosure, and is not a comprehensive disclosure of its full scope or all of its features.

According to several embodiments, a railway service vehicle, includes a body having a substantially flat platform. A plurality of wheels rotatably connected to the body are adapted to support the body on first and second rails of a railroad track system for movement of the body. At least one mounting device is connected to the platform. A hold-down member releasably connected to the at least one mounting device has a connection to restrain a wheelchair and/or emergency responder evacuation chair supported on the platform.

According to other embodiments, a railway service vehicle includes a body having a substantially flat platform. A plurality of wheels rotatably connected to the body are adapted to support the body on first and second rails of a railroad track system for non-self propelled movement of the body. At least one mounting device is connected to the platform. A hold-down member releasably connected to the at least one mounting device has a connection to restrain a wheelchair and/or emergency responder evacuation chair supported on the platform. Oppositely positioned first and second containment members are individually rotatably connected to the body and rotatable from an upright position preventing the wheelchair and/or emergency responder evacuation chair from displacement past either of the containment members, to a downward position permitting personnel access to the wheelchair and/or emergency responder evacuation chair.

According to further embodiments, a railway service vehicle includes a body having a substantially flat platform. A plurality of wheels rotatably connected to the body are adapted to support the body on first and second rails of a railroad track system for non-self propelled movement of the body. At least one mounting device is connected to the platform. A hold-down member releasably connected to the at least one mounting device has a connection to restrain a wheelchair and/or emergency responder evacuation chair supported on the platform. A ramp member is connected to the body and is movable from a stowed position to a deployed position for moving the wheelchair and/or emergency responder evacuation chair onto and off of the body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 3 is a top plan view of the railway service vehicle of FIG. 1;

FIG. 4 is a left side elevational view of the railway service vehicle of FIG. 1;

FIG. 7 is a top plan view of the railway service vehicle of FIG. 5;

FIG. 8 is a left side elevational view of the railway service vehicle of FIG. 5;

Corresponding reference numerals indicate corresponding parts throughout the several views of the drawings.

DETAILED DESCRIPTION

Figure 1:
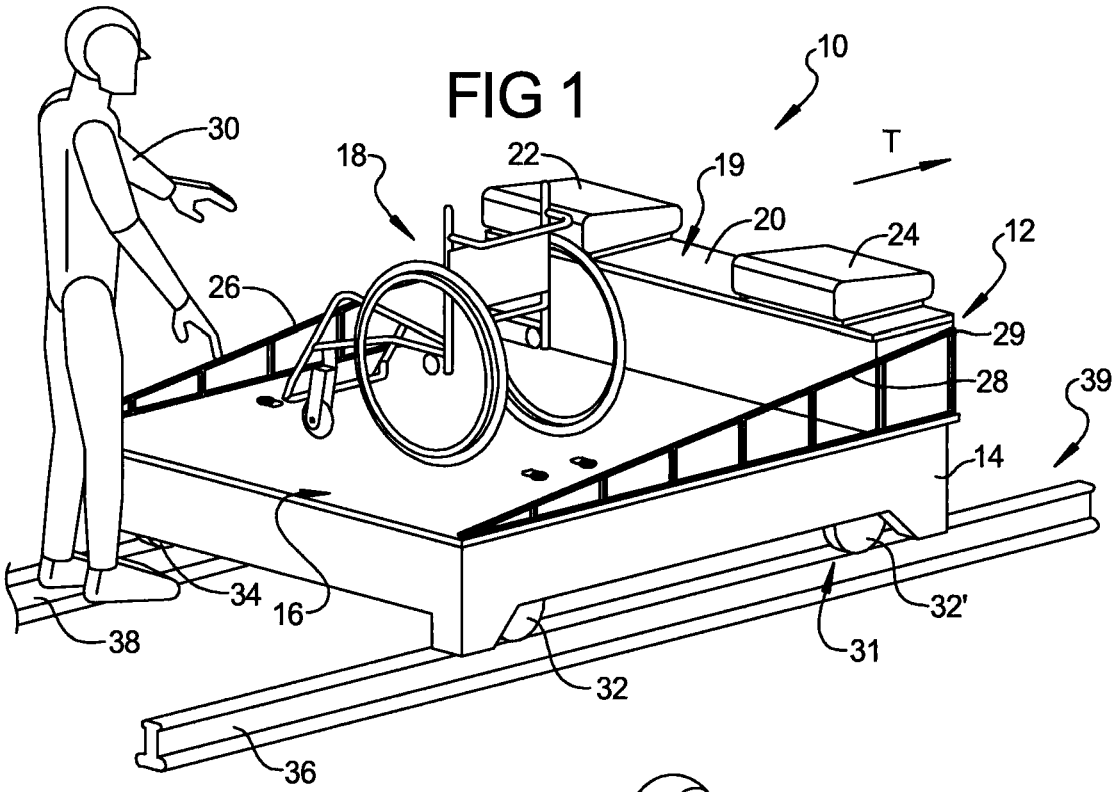
FIG. 1 is a front left perspective view of a flatbed railway service vehicle adapted to restrain at least one wheelchair and/or emergency responder evacuation chair.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a railway service vehicle 10 includes a car assembly 12 having a car body 14 and a flat platform 16. At least one and according to several embodiments multiple emergency support devices 18 shown for example as wheelchairs and/or emergency responder evacuation chair can be positioned on and temporarily secured to platform 16 for transportation of wheelchair and/or emergency responder evacuation chair bound persons from accident sites such as tunnel areas or subway sections where ready access to evacuate wheelchair-bound people is normally unavailable. Emergency support devices 18 can also include but are not limited to Stokes and/or Ferno baskets, backboards, seats, medical equipment and the like for holding injured persons or emergency equipment for transport to or from an emergency site.

A cover such as a releasable surface 19 can be provided on a container 20 such as a storage/tool container which is connected to platform 16. First and second passenger seats 22, 24 can be connected to releasable surface 19 so that at least one rider such as an emergency medical technician or a railroad employee can accompany the person sitting in the wheelchair and/or emergency responder evacuation chair 18. Car assembly 12 can further include first and second containment members 26, 28 which act as side rails to help restrain equipment or persons transported on car assembly 12. A connecting device 29 can be provided with both the first and second containment members 26, 28 to either fix the first and second containment members 26, 28 to the container 20, or to releasably connect the first and second containment members 26, 28. An elevation of the platform 16 with respect to an emergency response person 30 is minimized to allow the response person 30 to either manually lift or roll the wheelchair and/or emergency responder evacuation chair 18 onto platform 16 and to secure the wheelchair 18 thereto.

Car assembly 12 can further include movement devices 31 which according to several embodiments include first and second side wheel sets 32, 32' and 34, 34' (34' is not visible in this view). First and second side wheel sets 32, 32' and 34, 34' are adapted for rolling travel on each of a first train rail 36 and a second train rail 38 of a railroad track system 39. Car assembly 12 of railway service vehicle 10 can be transported in a tow direction "T" by pushing or pulling the car assembly 12 using a motorized transport vehicle (not shown). Car assembly 12 of railway service vehicle 10 is therefore a non-motorized vehicle which can be pushed or pulled to the service site and used for example to remove wheelchair bound people from railway accident areas, fires, collapsed tunnels, and the like.

Figure 2:
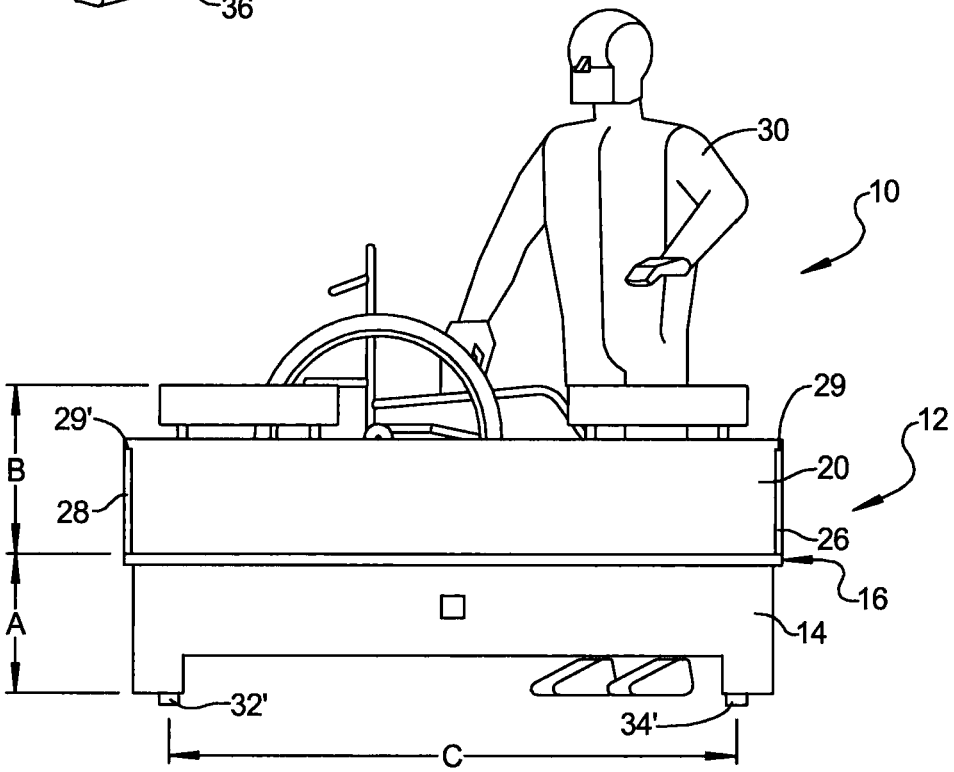
FIG. 2 is a rear elevational view of the railway service vehicle of FIG. 1.

Referring to FIG. 2, railway service vehicle 10 can include a body height "A" of car body 14 and a component envelope "B" for items supported on platform 16. A wheel/rail spacing "C" equals a similar spacing between first and second train rails, 36, 38 shown and described in reference to FIG. 1.

Component envelope "B" is defined with first and second passenger seats 22, 24 in down-folded or rotated positions.

Referring to FIG. 3, according to several embodiments railway service vehicle 10 can be adapted to support a first wheelchair and/or emergency responder evacuation chair 18 using a plurality of mounting devices connected to platform 16. These mounting devices can include first, second, third and fourth mounting devices 40, 42, 44, 46. According to several embodiments the first, second, third and fourth mounting devices 40, 42, 44, 46 can be anchor assemblies similar to those shown in U.S. Pat. No. 6,641,342 to Girardin. Other types of mounting devices can also be used which are adapted to permit temporarily restraining wheelchair and/or emergency responder evacuation chair 18 to platform 16. Restraint of wheelchair and/or emergency responder evacuation chair 18 can therefore be accomplished using the mounting devices arranged as a mounting device set 47, for example having a mounting device spacing "D". Mounting device set 47 can be used to orient wheelchair and/or emergency responder evacuation chair 18 in a transverse or sideways configuration with respect to railway service vehicle 10. At least one, and according to several embodiments a plurality of hold-down members 48 are adapted to be connected to individual ones of the first, second, third, and fourth mounting devices 40, 42, 44, 46. Hold-down members 48 can be, for example, flexible straps made from a fiber or cloth material having a loop as a connection to wheelchair 18, or can also be fastener devices providing a connection to wheelchair 18. Multiple mounting device sets 47 can also be used to permit rapid connection of the hold-down members 48 to minimize the time required to load and transport wheelchair and/or emergency responder evacuation chair 18.

Using the transverse mounting configuration of mounting device set 47 as shown, a first access space 50 and a second access space 52 are provided on opposite sides of wheelchair and/or emergency responder evacuation chair 18 for accessibility by the response person 30. Second access space 52 is also provided for personnel space for personnel seated on either or both of the first and second passenger seats 22, 24. Access is provided by second access space 52 for personnel access into the container 20 where items such as hold down members 48 or tools adapted for connection of the wheelchair 18 to platform 16 can be stowed. A bar 54 connected to a body end 55 of car body 14 can be used to push or pull railway service vehicle 10 for non-self propelled versions of railway service vehicle 10. A body width "E" can be selected by either the manufacturer or the purchaser of railway service vehicle 10 to accommodate more or less of the components shown, or to accommodate one, two, or more than two wheelchairs and/or emergency responder evacuation chairs 18.

Referring to FIG. 4, a body side 56 of car body 14 can include a side cavity 58 which provides access for maintenance such as lubrication or replacement of first and second side wheel sets 32, 32', 34, 34' (only first side wheel set 32, 32' is shown). A body length "G", similar to the body width "E" can be chosen by the manufacturer or a purchaser of railway service vehicle 10. According to several embodiments first and second containment members 26, 28 (only second containment member 28 is shown in this view) can be connected to an end panel 60 provided on opposite ends of container 20. This provides for additional rigidity of the first and second containment members 26, 28. First and second passenger seats 22, 24 are shown in FIG. 4 in their rotated down or stowed positions. A responder height "F" is accommodated in the design dimensions of railway service vehicles 10 such that response personnel 30 can manually access any of the items including the wheelchair and/or emergency responder evacuation chair 18 and/or the container 20 without stepping onto railway service vehicle 10.

Figure 5:
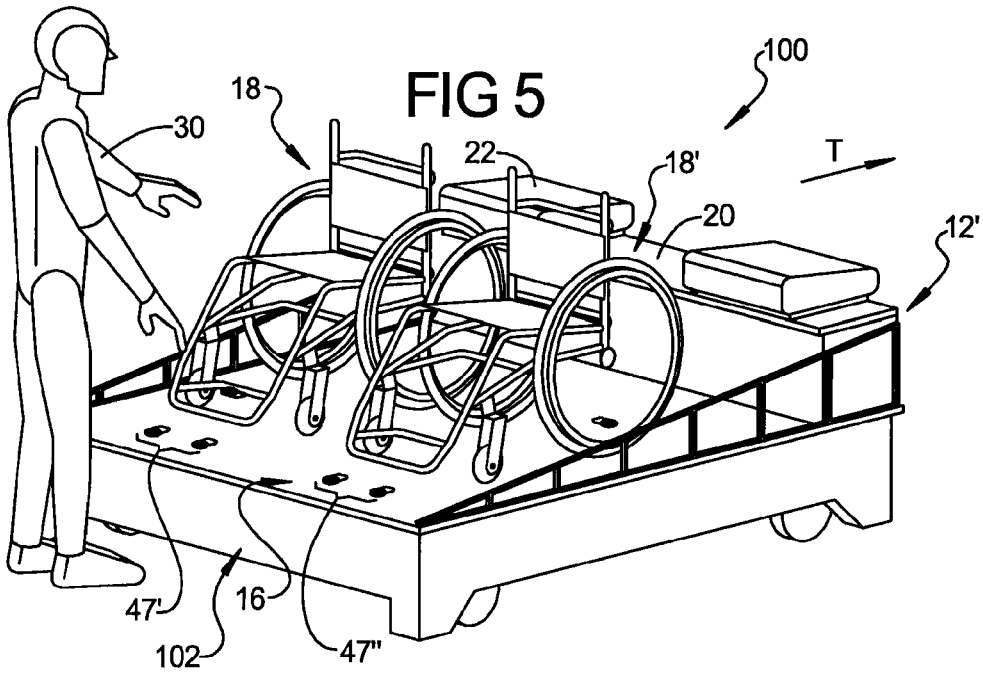
FIG. 5 is a front left perspective view of another embodiment of a flatbed railway service vehicle adapted to restrain at least one wheelchair and/or emergency responder evacuation chair.

Referring to FIG. 5 and again to FIG. 1, a railway service vehicle 100 according to other embodiments of the present disclosure is modified from railway service vehicle 10 to allow for an increased number of wheelchairs and/or emergency responder evacuation chairs, which according to several embodiments can include first and second wheelchairs and/or emergency responder evacuation chairs 18, 18'. According to several embodiments two mounting device sets 47', 47" can be connected to platform 16 and oriented in a fore/aft orientation to allow for side-by-side loading of wheelchairs and/or emergency responder evacuation chairs 18, 18' facing a body front member 102 facing side of the car assembly 12'. Both wheelchairs and/or emergency responder evacuation chairs 18, 18' can therefore be simultaneously loaded onto platform 16 if a sufficient number of personnel 30 are available. Wheelchairs and/or emergency responder evacuation chairs 18, 18' can be restrained in the orientation shown having the occupants of wheelchairs and/or emergency responder evacuation chairs 18, 18' facing toward body front member 102. Wheelchairs 18, 18' can also be oppositely oriented from the configuration shown in FIG. 5 such that the occupants would face in the tow direction "T".

Figure 6:
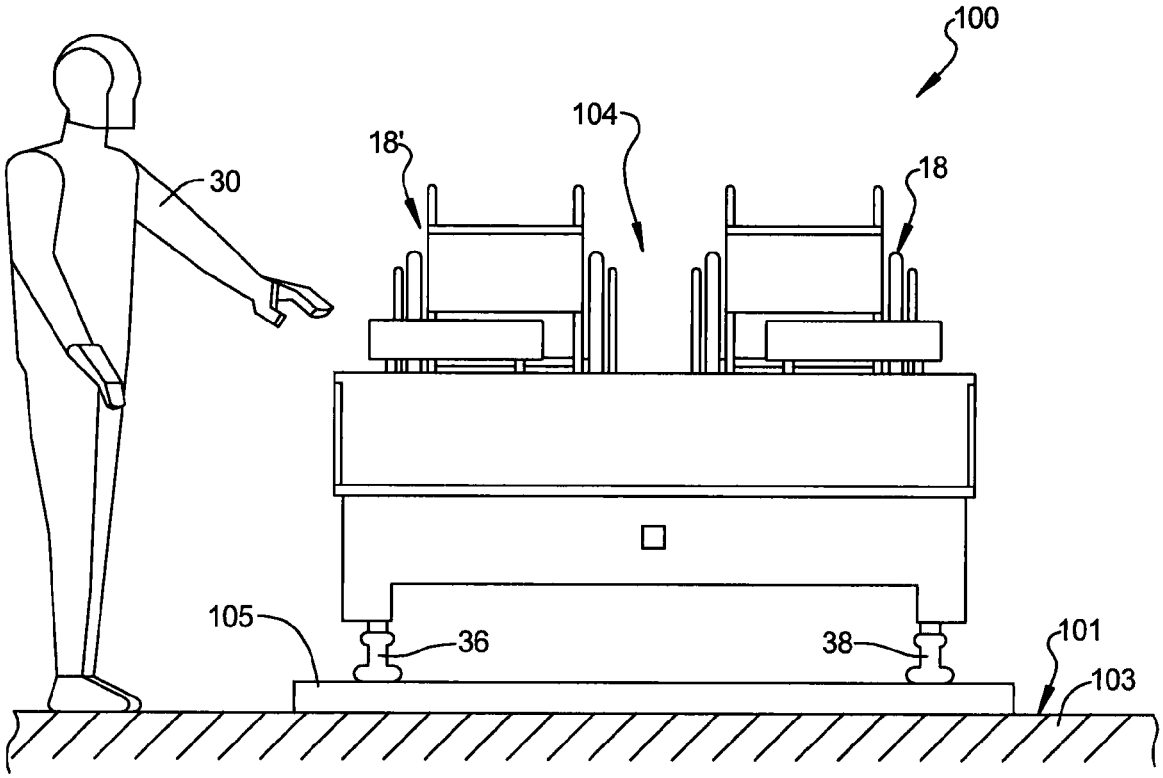
FIG. 6 is a rear elevational view of the railway service vehicle of FIG. 5.

Referring to FIG. 6, a bed surface 101 of a rail bed 103 is commonly a flat or substantially planar surface proximate to the first and second train rails, 36, 38, which are commonly supported by tie members 105. However, because railway service vehicle 100 (as well as railway service vehicle 10 shown and described in reference to FIG. 1) are adapted to be supported on the first and second train rails 36, 38, railway service vehicles of the present disclosure can be operated, loaded, or unloaded by personnel 30 when supported on either planar or uneven bed surfaces 101. A third access space 104 provided between wheelchairs 18, 18' provides for manual access between the wheelchairs and/or emergency responder evacuation chairs 18, 18' as well as clearance between occupants of the wheelchairs and/or emergency responder evacuation chairs.

Referring to FIG. 7, the two sets of mounting device sets 47', 47" are configured having an inboard mounting device 106 and an outboard mounting device 108 spaced by a mounting device spacing "D'". The inboard mounting device 106 and the outboard mounting device 108 of both sets of mounting device sets 47', 47" can be spaced from body front member 102 using a device locating dimension "H" so that both wheelchairs and/or emergency responder evacuation chairs 18, 18' can be equally spaced with respect to body front member 102. The third access space 104 is generally equally divisible about a vehicle longitudinal axis 110 to provide equal weight distribution on railway service vehicle 100.

A first forward inboard mounting device 112 and a second forward inboard mounting device 114 can be spaced using a side-to-side spacing dimension "S" which is also centrally divided with respect to vehicle longitudinal axis 110. The first and second forward inboard mounting devices 112, 114 as well as their respective outboard mounting devices can be equally spaced using a device-to-device spacing dimension "J" with respect to the inboard and outboard mounting devices 106, 108. According to additional embodiments the device to device spacing "J" can be varied for each of the wheelchairs and/or emergency responder evacuation chairs 18, 18' to accommodate different size units of the wheelchairs and/or emergency responder evacuation chairs 18, 18'. A container width "K" of container 20 can also be varied at the discretion of the manufacturer or purchaser in addition to varying the body width "E'".

Referring to FIG. 8, a seat back 116 of each of the first and second passenger seats 22, 24 is shown in an upright position with respect to a seat cushion 118. Passengers on railway service vehicle 100 are therefore provided with additional back support when seat backs 116 are rotated to the upright positions shown. According to several embodiments bar 54 can also be connected to body front member 102 shown in phantom as bar 54'. Bar 54' can also be rotatably connected to body front member 102 to allow bar 54' to be moved out of the way during loading or unloading of wheelchairs 18, 18'. As previously identified herein, the overall space envelope of railway service vehicles of the present disclosure can be varied at the discretion of the manufacturer or the purchaser, therefore allowing body length "G'" to be also varied as desired.

With further reference to FIG. 8, according to several embodiments a propulsion device 120 such as an electric motor or an engine/transmission can be incorporated to allow self-propulsion of railway service vehicles of the present disclosure. Bar 54 can be eliminated in the self-propelled versions. An energy source 122 can also be included to provide propulsive energy such as a battery, if propulsion device 120 is an electric motor, or a fuel tank for fuel such as gasoline, diesel fuel, or the like, if propulsion device 120 includes an engine/transmission.

Figure 9:
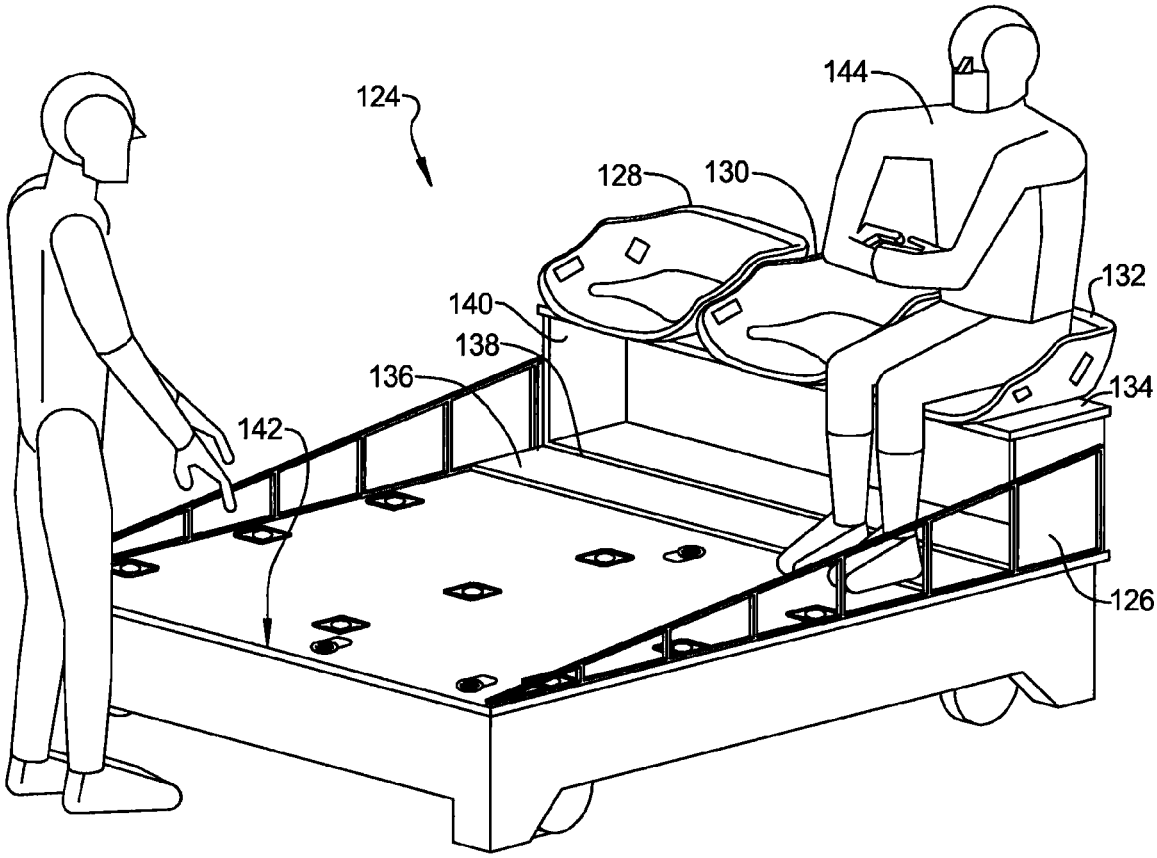
FIG. 9 is a front left perspective view of a flatbed railway service vehicle modified from the service vehicle of FIG. 1.

Referring to FIG. 9, a railway service vehicle 124 is modified to include a storage/tool container 126 which supports first, second, and third passenger seats 128, 130, 132. First, second, and third passenger seats 128, 130, 132 are connected to a fixed surface 134 of storage/tool container 126. A rotatable door 136 is connected to storage/tool container 126 by a door hinge 138. A container inner space 140 is provided within storage/tool container 126 which is accessible when rotatable door 136 is open as shown. Rotatable door 136 is rotatable about door hinge 138 to a fully open position where it contacts a platform 142 of railway service vehicle 124. In the fully open position, a response personnel 144 seated on any of the passenger seats can support their feet directly on either the rotatable door 136 or the platform 142.

Figure 10:
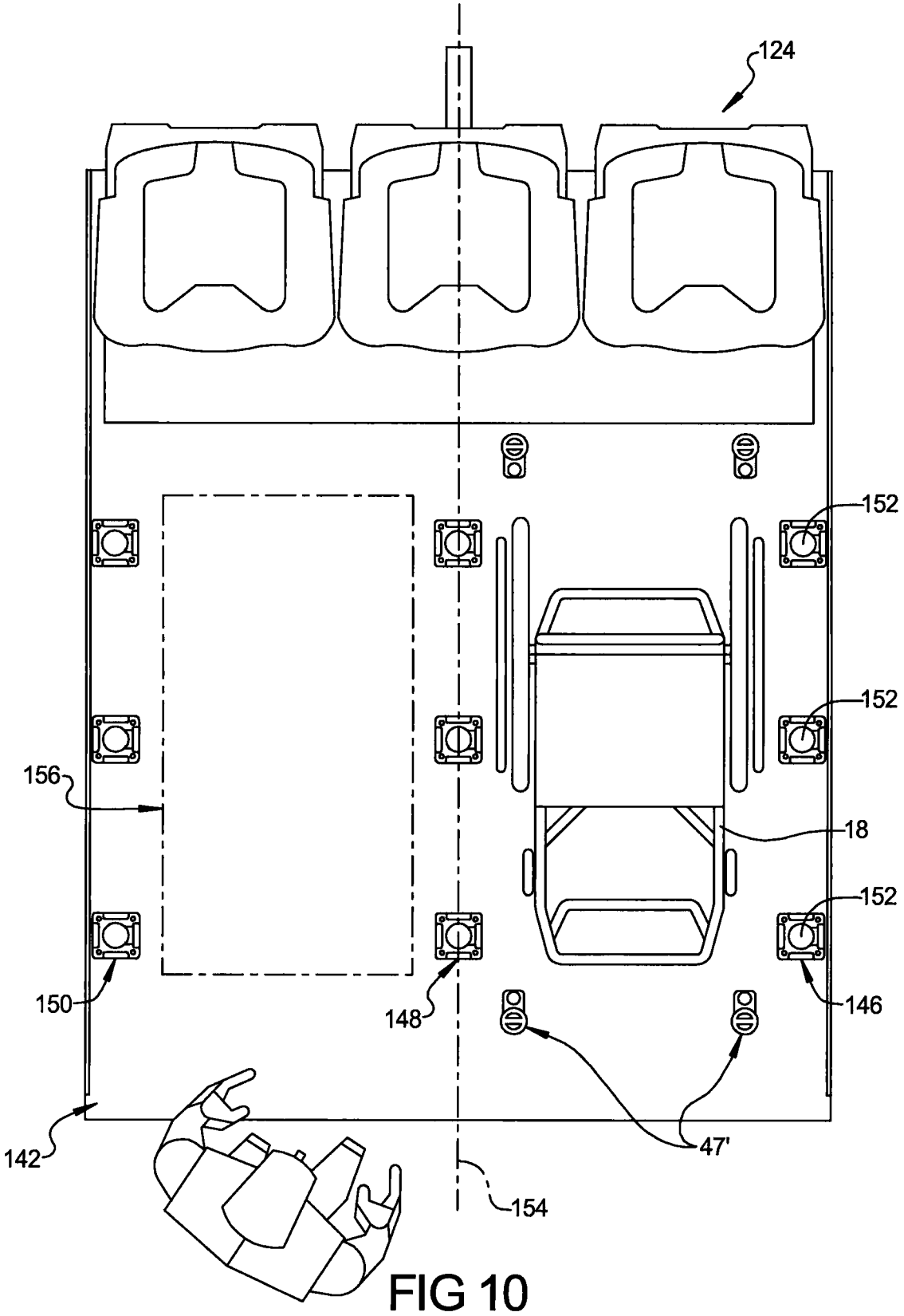
FIG. 10 is a top plan view of the railway service vehicle of FIG. 9.

Referring to FIG. 10, further items included with railway service vehicle 124 include first, second, and third recessed connection sets 146, 148, 150 which are fastened or otherwise fixed to platform 142 in parallel configurations as shown. Each of the first, second, and third recessed connection sets 146, 148, 150 include a connector member 152 which according to several embodiments can be a D-ring or similar device adapted to provide a rotatable connection member to releasably fasten items to the platform 142. Each of the second recessed connection set 148 members are axially aligned on a vehicle longitudinal axis 154 which centrally positions the recessed connections between for example the wheelchair and/or emergency responder evacuation chair 18 and a item receiving space 156. The second recessed connection set 148 can therefore be used to releasably connect items on either side of the connection set or both sides of the connection set. The first, second, and third recessed connection sets 146, 148, 150 are provided in addition to the mounting device sets 47 previously described herein.

Figure 11:
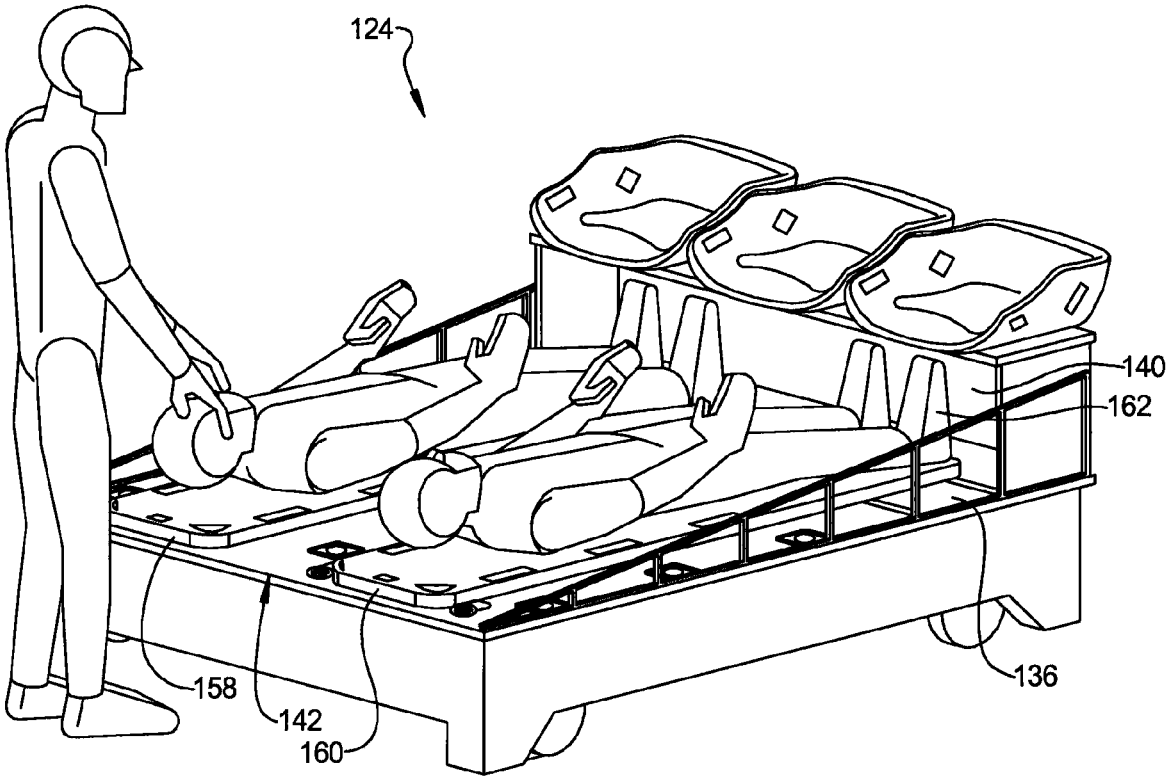
FIG. 11 is a front left perspective view of the railway service vehicle of FIG. 9 having injured persons horizontally positioned for transportation in place of one or more wheelchairs and/or emergency responder evacuation chair.

Referring to FIG. 11, railway service vehicle 124 can be adapted to receive first and second backboards 158, 160 such that injured persons can be horizontally supported with respect to platform 142 in a side by side configuration. With the rotatable door 136 positioned in the fully rotated position the container inner space 140 is further available to receive a body portion 162 such as the lower legs and feet of one or both of the injured persons. This provides greater flexibility in particular for transportation of taller persons.

Figure 12:
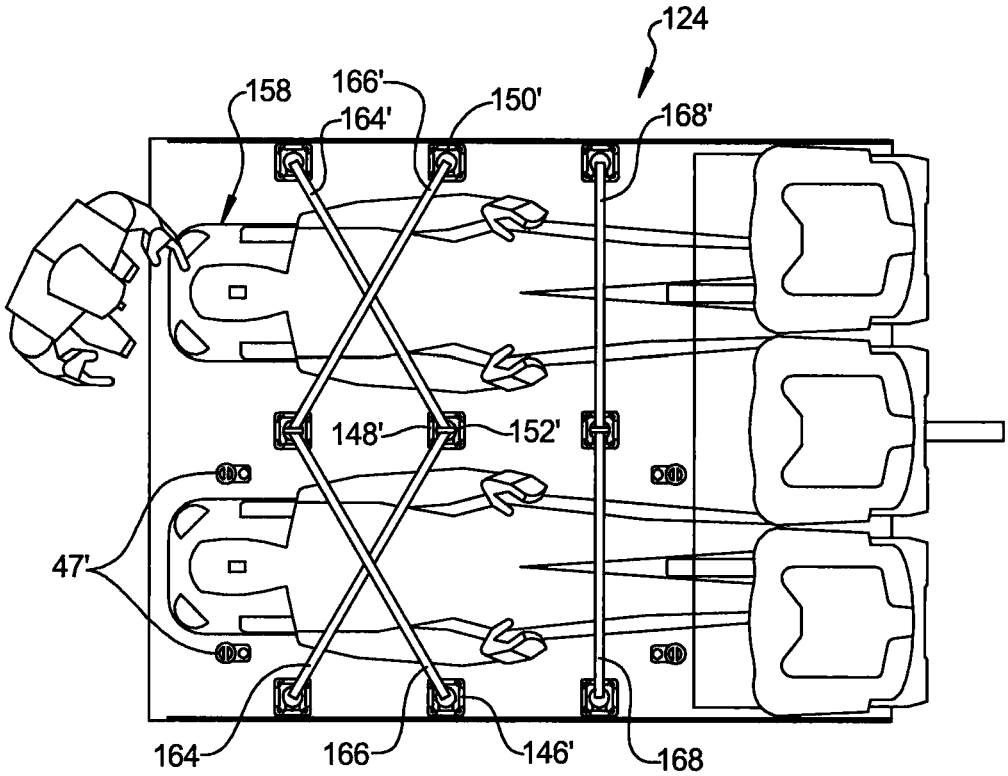
FIG. 12 is a top plan view of the railway service vehicle of FIG. 11.

Referring to FIG. 12, when railway service vehicle 124 is used to transport horizontally positioned persons one or more flexible straps such as first, second, and third patient straps 164, 166, 168 can be connected to oppositely positioned ones of the first, second, or third recessed connections 146', 148', 150' by looping the straps through individual ones of the connection members 152'. The mounting device sets 47 can be used as well or can be unused for this operation.

Figure 13:
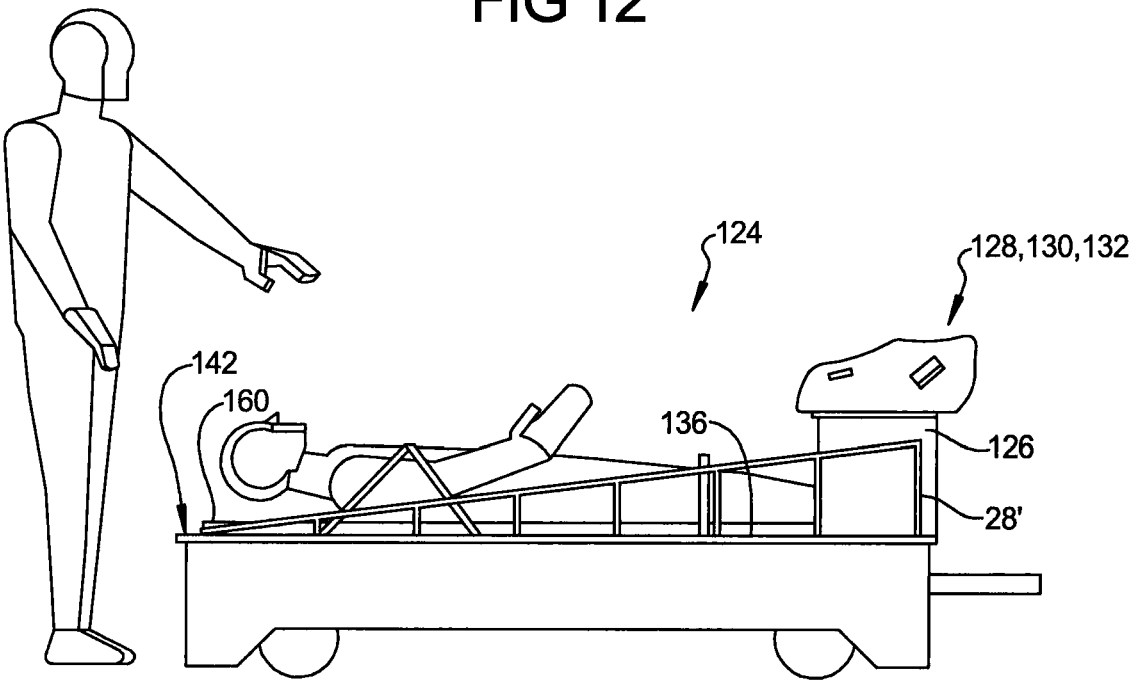
FIG. 13 is a side elevational view of the railway service vehicle of FIG. 12.

Referring to FIG. 13, because platform 142 is substantially planer positioning either the first or second backboard 158, 160 (only second backboard 160 is visible in this view) onto platform 142, the first and second backboards 158, 160 will be horizontally oriented to support injured persons who are not capable of being seated in any of the first, second, or third passenger seats 128, 130, 132. The first and second containment members 26, 28 (shown in this view only as second containment member 28') can be positioned in the upright orientation against storage/tool container 126 as shown or moved out of the path for example by rotation to provide greater access to platform 142. Returning the containment members to their upright positions after the loading of platform 142 provides additional retention capability at the outer boundaries of railway service vehicle 124.

Figure 14:
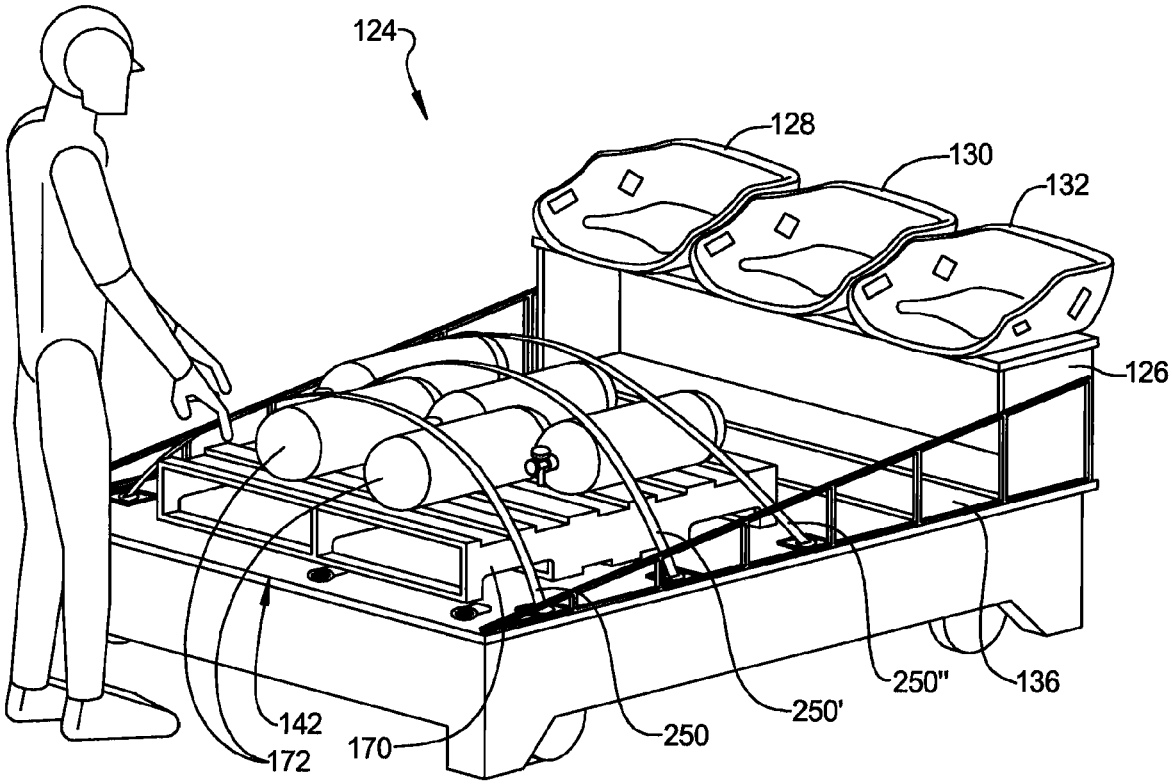
FIG. 14 is a front left perspective view of the railway service vehicle of FIG. 9 having emergency response equipment secured for transportation.

Referring to FIG. 14 and again to FIG. 12, in addition to the capability of carrying wheelchair and/or emergency responder evacuation chair bound and/or injured persons away from an accident site railway service vehicle 124 can further be used to carry equipment used for emergency response to the accident site. In one exemplary embodiment, a pallet 170 is shown loaded onto platform 142 having at least one and a plurality of emergency response equipment items 172 supported from pallet 170. Emergency response equipment 172 can include but is not limited to pressurized air bottles for use by fire fighting personnel, pressurized oxygen bottles for use with injured persons, fire fighting equipment, emergency responder equipment, and the like. Each of the items of emergency response equipment 172 as well as the pallet 170 can be secured to platform 142 using the first, second, and third cargo straps 250, 250', 250" which are different from straps used to restrain patients such as patient straps 164, 166, 168 shown and described in reference to FIG. 12. Rotatable door 136 can be positioned in the fully open position shown or rotated into contact with storage/tool container 126 for this operation. Emergency response personnel such as emergency medical technicians, fire fighters, or railroad personnel can also be carried in together with emergency response equipment 172 by seating on the first, second, or third passenger seats 128, 130, 132.

Referring to FIG. 15 and again to FIG. 1, a railway service vehicle 174 is modified from railway service vehicle 10 to further include first and second containment members 176, 178 (only second containment member 178 is clearly visible in this view) which each have a rear railing post 180 slidably and releasably received in a rear side railing holder 182 connected to opposite first and second car body walls 181, 183 (only second car body wall 183 is visible in this view), and each have a front railing post 184 slidably and releasably received in a front side railing holder 186 also connected to each of the first and second car body walls 181, 183. A rear trailer hitch 188 and a front trailer hitch 190 are connected to opposite ends of a car body 191. At least one of the first and second car body side walls 181, 183 also have a manually actuated emergency brake lever 192 mounted thereto, which permit an occupant of or a person standing beside railway service vehicle 174 to manually rotate to releasably apply a brake holding the position of railway service vehicle 174. Emergency brake lever 192 is shown in a forward rotated position allowing motion of railway service vehicle 174, and is rotated approximately 180 degrees to a rearward position to brake railway service vehicle 174. An emergency brake mushroom button 194 is also provided on a rear facing support column 195 of a passenger support member/storage/tool container 196. A direction of travel "L" is shown for railway service vehicle 174, however this direction of travel is also reversible for operation in an opposite direction.

Figure 16:
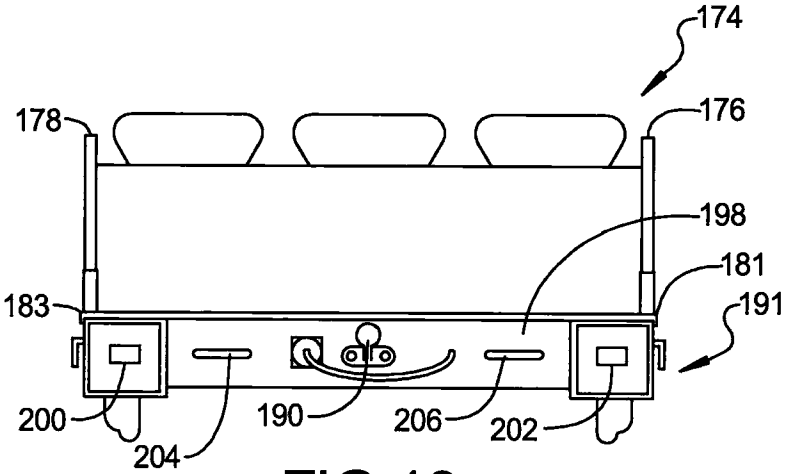
FIG. 16 is a front elevational view of the flatbed railway service vehicle of FIG. 15.

Referring to FIG. 16, a rear body wall 198 of car body 191 includes first and second directional lights 200, 202, and first and second carry handles 204, 206 fixed to rear body wall 198. First and second carry handles 204, 206 permit manual lifting of railway service vehicle 174 onto or off of a set of railway tracks, shown and described in reference to FIG. 1. Power to operate first and second directional lights 200, 202 can be provided by the self propulsion system (if provided) for railway service vehicle 174, or from a tow vehicle (not shown).

Figure 17:
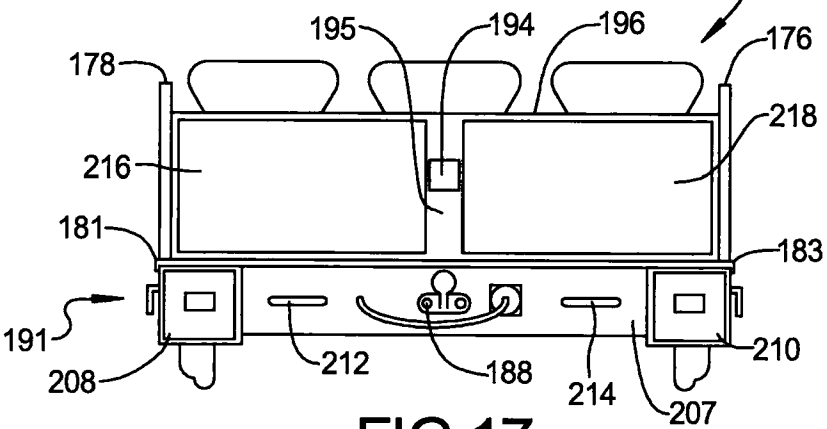
FIG. 17 is a rear elevational view of the flatbed railway service vehicle of FIG. 15.

Referring to FIG. 17 and again to FIG. 16, similar to front body wall 198, a rear body wall 207 of car body 191 includes third and fourth directional lights 208, 210, and third and fourth carry handles 212, 214 fixed to rear body wall 207. Third and fourth carry handles 212, 214 similarly permit manual lifting of railway service vehicle 174 onto or off of a set of railway tracks, shown and described in reference to FIG. 1. Power to operate third and fourth directional lights 208, 210 can similarly be provided by the self propulsion system (if provided) for railway service vehicle 174, or from a tow vehicle (not shown). The emergency brake mushroom button 194 is connected to rear facing column 195 of passenger support member/storage/tool container 196 such that rear facing column 195 separates first and second cavities 216, 218 provided with container 196. The position of emergency brake mushroom button 194 locates this device below a middle seat and for access by any of three occupants of the three seats positioned on passenger support member/storage/tool container 196, as well as by occupants on car body 191 during travel.

Figure 18:
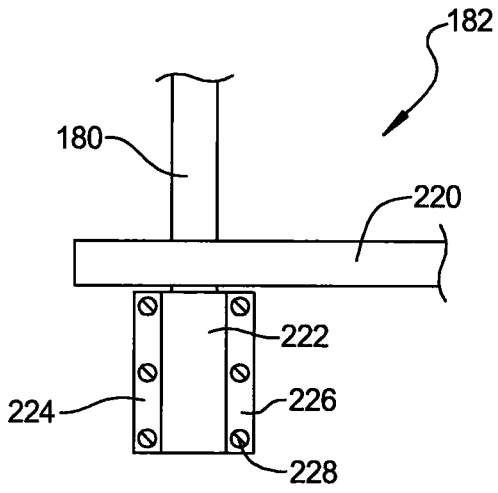
FIG. 18 is a side elevational view of a rear side railing holder taken at area 18 of FIG. 15.

Referring to FIG. 18 and again to FIG. 15, rear side railing holders 182 are each positioned below a platform 220 and include a U-shaped bracket 222 having opposed mounting flanges 224, 226. A plurality of fasteners 228, or welding joints can be used to fixedly connect rear side railing holders 182 to the first and second car body side walls 181, 183.

Figure 19:
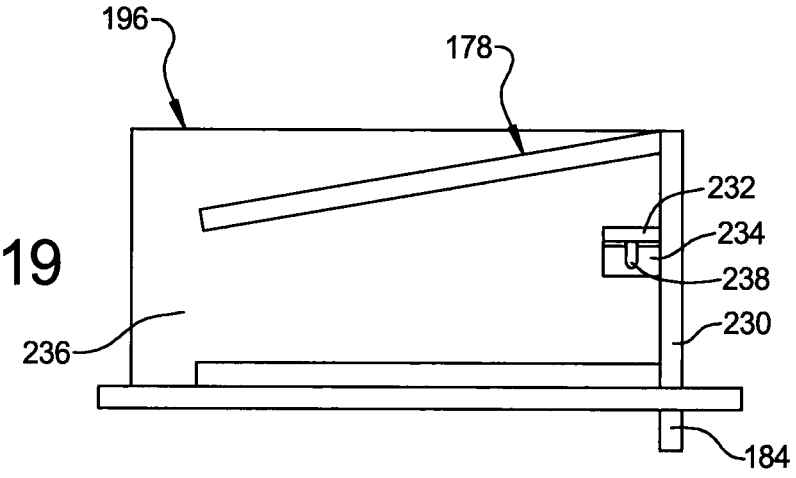
FIG. 19 is a side elevational view of a front side railing holder taken at area 19 of FIG. 15.

Referring to FIG. 19, in addition to the support provided by front railing post 184, a front vertical end tube 230 from which front railing posts 184 extend can further include an arm 232 fixed to the front vertical end tube 230 and extending rearward. The arm 232 is positioned above a connection member 234 fixed to a side wall 236 of container 196. A pin 238 is slidably disposed through arm 232 and into connection member 234 to releasably lock first and second containment members 176, 178 (only second containment member 178 is clearly visible in this view) in their installed positions.

Figure 20:
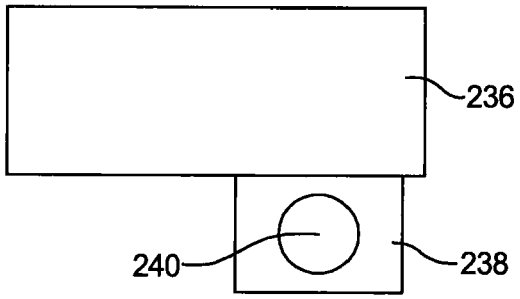
FIG. 20 is a top plan view of the front side railing holder of FIG. 19.

Referring to FIG. 20 and again to FIG. 19, an aperture 240 is created through connection member 234 to receive pin 238. Pin 238 can be a manually inserted pin or a biased pin which when released automatically extends into aperture 240.

Figure 21:
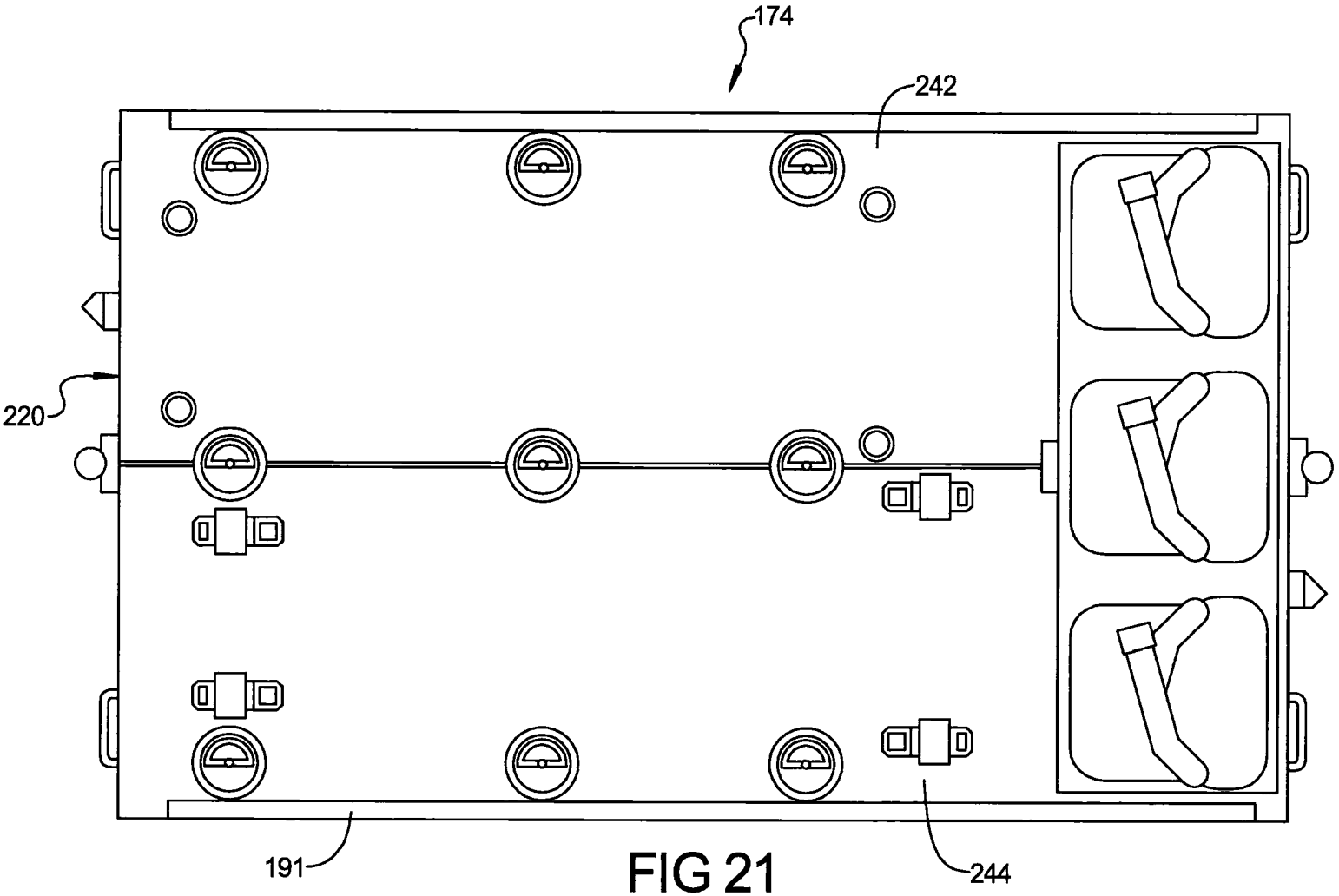
FIG. 21 is a top plan view of the flatbed railway service vehicle of FIG. 15.

Referring to FIG. 21, the platform 220 of railway service vehicle 174 can be divided into multiple sections for removal if desired. According to several embodiments, platform 220 includes first and second platform sections 242, 244 which can be releasably or permanently connected to car body 191.

Figure 15:
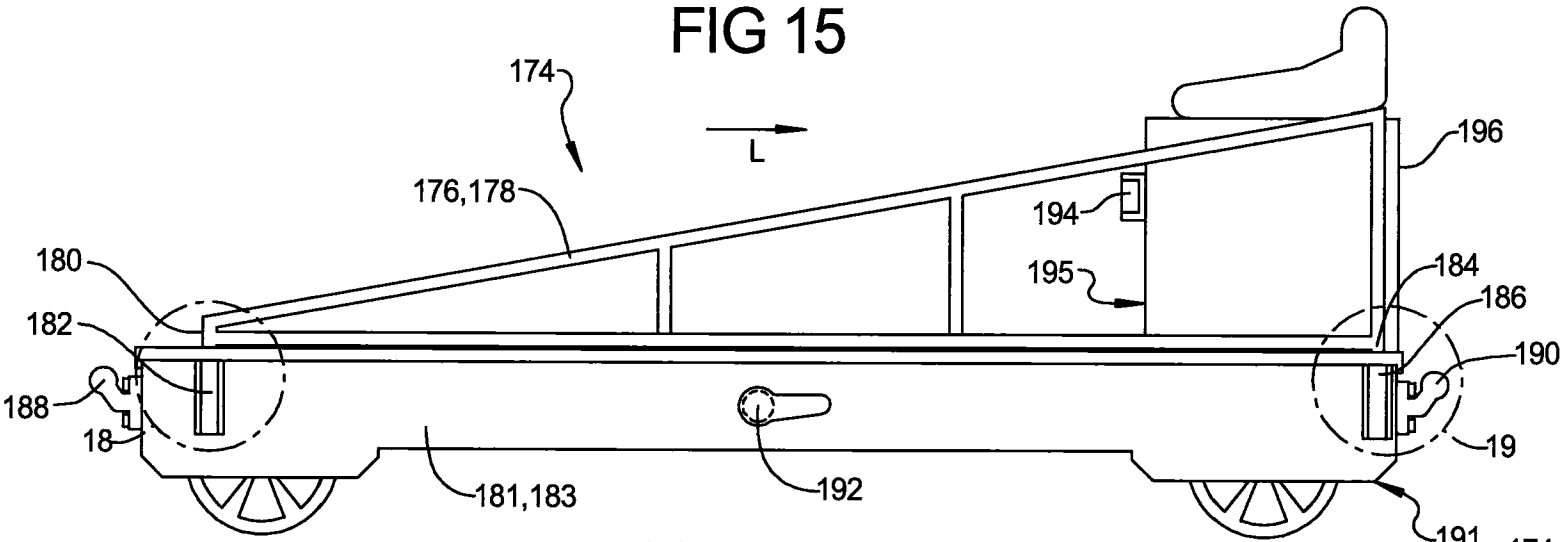
FIG. 15 is a side elevational view of a flatbed railway service vehicle modified from the service vehicle of FIG. 1.
Figure 22:
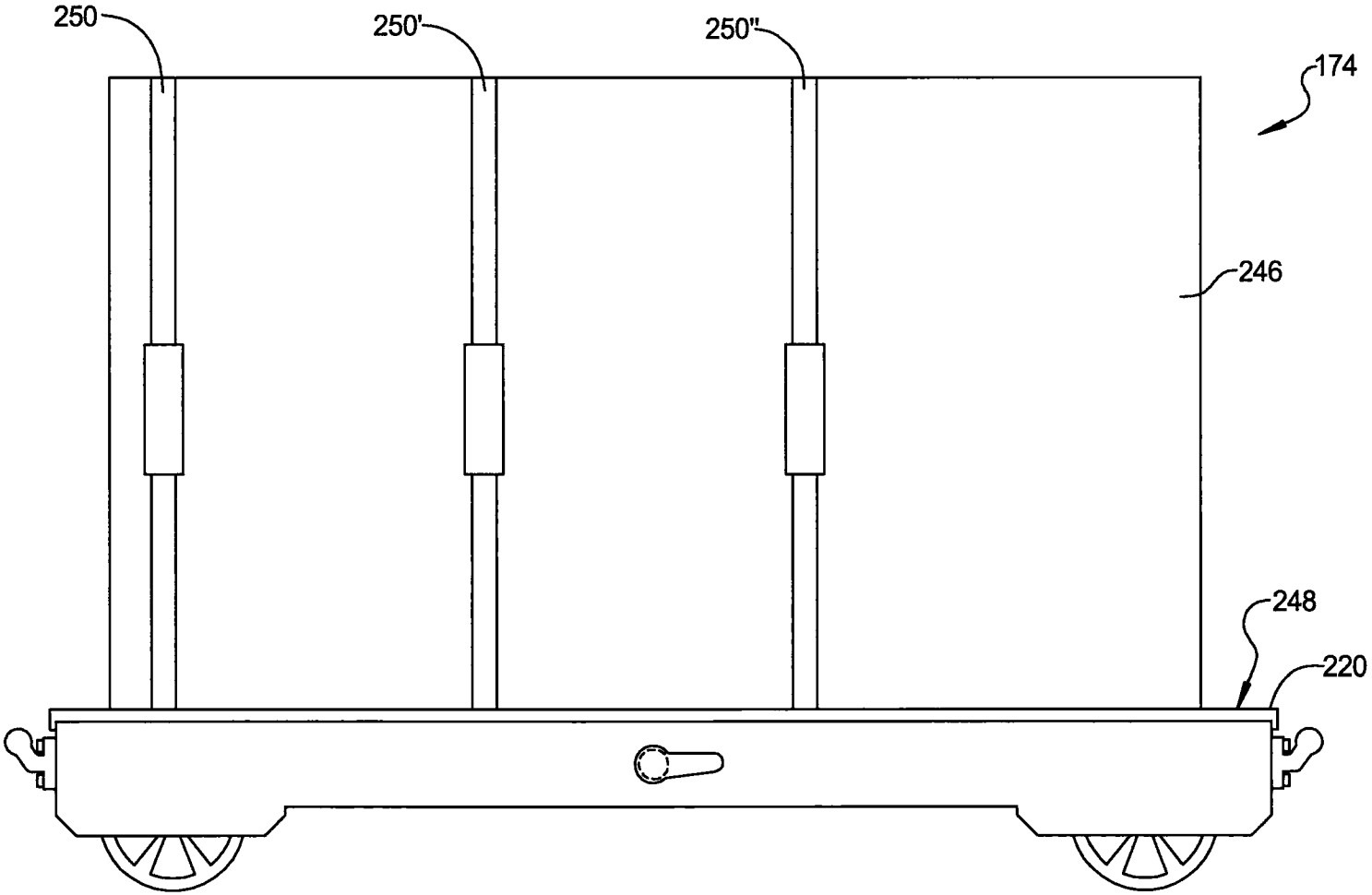
FIG. 22 is a side elevational view of the flatbed railway service vehicle modified from the service vehicle of FIG. 15.

Referring to FIG. 22 and again to FIG. 15, the passenger support member/storage/tool container 196 can be completely removed to permit railway service vehicle 174 to carry one or more larger cargo containers such as a cargo container 246. Cargo container 246 can be sized to occupy substantially all of an upper facing planar surface 248 of platform 220. A plurality of hold-down straps 250, 250', 250" can be used to temporarily secure cargo container 246 to platform 220

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A railway service vehicle, comprising:

a body having a platform;

a plurality of movement devices connected to the body to support the body on first and second rails of a railroad track system for movement of the body;

at least one mounting device connected to the platform;

a hold-down member releasably connected to the at least one mounting device having a connection to restrain an emergency support device on the platform;

a storage/tool container connected to the platform having a releasable surface; and at least one passenger seat rotatably connected to the releasable surface of the storage/tool container adapted for rotation between folded-down and upright positions.

2. The railway service vehicle of claim 1, further including opposed first and second containment members connected to the platform outboard of the at least one mounting device.

3. The railway service vehicle of claim 1, further comprising a bar connected to a body end of the body used to push or pull the railway flatbed service vehicle.

4. The railway service vehicle of claim 1, further comprising a hitch connected to a body end of the body used to push or pull the railway flatbed service vehicle.

5. The railway service vehicle of claim 1, further comprising at least one directional light connected to a body end of the body.

6. The railway service vehicle of claim 1, further comprising a carry handle connected to a body end of the body provided to manually lift the railway flatbed service vehicle.

7. The railway service vehicle of claim 1, further comprising an emergency brake lever connected to a body side wall of the body used to push or pull the railway flatbed service vehicle.

8. The railway service vehicle of claim 1, wherein the movement devices are wheels rotatably connected to the body.

9. The railway service vehicle of claim 1, wherein the movement devices are skis connected to the body.

10. The railway service vehicle of claim 1, wherein the movement devices are low friction members connected to the body allowing the body to slide.

11. The railway service vehicle of claim 1, further comprising:

a rotatable door connected to the storage/tool container by a door hinge; and a container inner space provided within the storage/tool container which is accessible to receive a portion of the emergency support device when the rotatable door is open and laying on the platform.

12. A railway service vehicle, comprising:

a body having a platform;

a plurality of wheels rotatably connected to the body supporting the body on first and second rails of a railroad track system for movement of the body;

multiple mounting devices defining a mounting device set connected to the platform;

a hold-down member releasably connected to each of the mounting devices to restrain a wheelchair on the platform;

a first access space and a second access space provided on opposite sides of the wheelchair for accessibility by a response person; and oppositely positioned first and second containment members individually connected to the body preventing the wheelchair from displacement past either of the containment members.

13. The railway service vehicle of claim 12, further including a storage container connected to the platform, wherein the first and second containment members each include a fastening device releasably connecting the first and second containment members to the storage container in an upright position of the first and second containment members.

14. The railway service vehicle of claim 13, further including at least one passenger seat rotatably connected to a releasable surface of the storage container.

15. The railway service vehicle of claim 13, further including a manually operated emergency brake device positioned proximate to the storage container, the emergency brake device operating when actuated to stop travel of the railway service vehicle.

16. The railway service vehicle of claim 12, wherein the first and second containment members are individually rotatably connected to the body.

17. The railway service vehicle of claim 12, wherein the first and second containment members each include posts that are individually received in holders connected to the body, the first and second containment members lifted free of the holders to remove the holders from the body.

18. A railway service vehicle, comprising:

a body having a platform and opposite first and second body walls;

a plurality of wheels rotatably connected to the body and spaced to permit supporting the body for movement on first and second rails of a railroad track system;

at least one mounting device connected to the platform;

a hold-down member releasably connected to the at least one mounting device to retain an emergency support device on the platform;

first and second containment members each having a rear railing post slidably and releasably received in a rear side railing holder each connected to one of the first or second body walls, and each having a front railing post slidably and releasably received in a front side railing holder also connected to each of the first and second body walls;

a container connected to a releasable surface of the body having at least one seat rotatably positioned on the releasable surface to permit an occupant to sit on the seat of the railway service vehicle during vehicle travel; and a plurality of handles connected to the body to permit the body to be manually lifted onto or off of the first and second rails.

19. The railway service vehicle of claim 18, further including oppositely positioned first and second containment members individually connected to the body and positionable in each of an upright position preventing the emergency support device from displacement past either of the containment members, and a release position permitting personnel access to the emergency support device.

20. The railway service vehicle of claim 18, further including a propulsion device to allow self-propulsion of the railway service vehicle.

21. The railway service vehicle of claim 18, wherein the container is removable such that a cargo container sized to occupy substantially all of an upper facing planar surface of the platform is supported by the platform.

* * * * *